United States Patent [19]

Isogai et al.

[11] 4,351,305

[45] Sep. 28, 1982

[54] FUEL INJECTION APPARATUS FOR AN INTERNAL COMBUSTION ENGINE

[75] Inventors: Kiyoshi Isogai, Toyota; Kazuyoshi Sugaya, Kariya, both of Japan

[73] Assignee: Nippondenso Co., Ltd., Kariya, Japan

[21] Appl. No.: 157,241

[22] Filed: Jun. 6, 1980

[30] Foreign Application Priority Data

Aug. 3, 1979 [JP] Japan ..... 54-98610

[51] Int. Cl.[3] ..... F02M 29/04

[52] U.S. Cl. ..... 123/590; 123/470; 123/445; 261/78 R; 261/DIG. 82; 261/DIG. 39

[58] Field of Search ..... 123/470, 472, 445, 590; 261/44 B, 52, DIG. 82, DIG. 39, 78 R

[56] References Cited

U.S. PATENT DOCUMENTS

| | | | |
|---|---|---|---|
| 2,732,193 | 1/1956 | Wentz, Jr. | 261/DIG. 56 |
| 3,334,876 | 8/1967 | Shorrock | 261/DIG. 56 |
| 3,680,846 | 8/1972 | Bickhaus et al. | 261/DIG. 56 |
| 4,221,747 | 9/1980 | Edmonston | 261/44 B |
| 4,272,460 | 6/1981 | Watanabe et al. | 123/472 |

*Primary Examiner*—Charles J. Myhre
*Assistant Examiner*—E. Rollins Cross
*Attorney, Agent, or Firm*—Cushman, Darby & Cushman

[57] ABSTRACT

A fuel injection apparatus for a multi-cylinder internal combustion engine, having a single fuel injection valve arranged above a throttle valve. A collector member arranged in a throttle bore of the engine so that the member faces the fuel injection nozzle. A cam and link mechanism adapted for connecting the collector member and a throttle shaft, so that a position of the collector member with respect to the axis of the throttle bore changes in accordance with the degree of the opening of the throttle valve. Therefore, an air fuel mixture having a constant air fuel ratio is supplied to all cylinders of the engine.

5 Claims, 5 Drawing Figures

FUEL INJECTION APPARATUS FOR AN INTERNAL COMBUSTION ENGINE

FIELD OF THE INVENTION

The present invention relates to a fuel injection apparatus for a multi-cylinder internal combustion engine, wherein a single fuel injection valve or nozzle is mounted above the throttle valve for supplying fuel to all cylinders of the engine. This type of apparatus is herein referred as a single point injection (SPI) type.

BACKGROUND OF THE INVENTION

An SPI type fuel injection system is provided with only one fuel injection valve for supplying fuel to all cylinders of an internal combustion engine. Therefore, cost for manufacturing such a type of apparatus can be decreased when compared with a conventional fuel injection apparatus wherein a plurality of fuel injection valves are provided in respective cylinders of the engine. However, the SPI type of fuel injection apparatus suffers from a disadvantage in that a difference in the air-fuel ratio, the value of which difference is changed in accordance with the degree of the throttle opening, takes place between the cylinders. This is because the value of the difference between the amount of air passed through one side of the throttle valve and the amount of air passed through the other side of the throttle valve changes in accordance with the degree of the throttle opening, while the amount of the fuel passed through one side of the throttle valve is, irrespective of the throttle opening, equal to the amount of fuel passed through the other side of the throttle valve. Due to the difference in the air-fuel ratio, an idealized operation of the engine cannot be obtained.

SUMMARY OF THE INVENTION

An object of the present invention is to provide a fuel injection apparatus for an internal combustion engine capable of maintaining a constant air fuel ratio between the cylinders of the engine.

According to the present invention a fuel injection apparatus for an internal combustion engine is provided, which includes a tubular body through which the intake air passes and a throttle valve arranged in the tubular body for controlling an amount of the flow passed through the body, said apparatus comprising:

- fuel injection nozzle means located above the throttle valve for providing a single flow of fuel discharged into the interior of the body along the direction substantially transverse to the axis of the body;
- guide or collector means arranged in the tubular body for changing the direction of the flow of fuel from the fuel injection nozzle means so that the axis of the flow is parallel to the axis of the tubular body; and
- drive means responsive to opening of the throttle valve for moving the guide means in the direction transverse to the axis of the tubular body, whereby the position of the axis of the flow of the fuel with respect to the axis of this tubular body is varied in accordance with the degree of the throttle opening. As a result of this the difference between the amount of fuel passed through one side of the throttle valve and the amount of fuel passed through the other side of the throttle valve changes in accordance with the throttle opening, so that an air-fuel mixture of substantially a constant air-fuel ratio may be passed through both sides of the throttle valve. Thus, an air-fuel mixture having a substantially constant air-fuel ratio can be supplied to all cylinders of the engine.

BRIEF DESCRIPTION OF THE ATTACHED DRAWINGS

DESCRIPTION OF A PREFERRED EMBODIMENT

Figure 1:
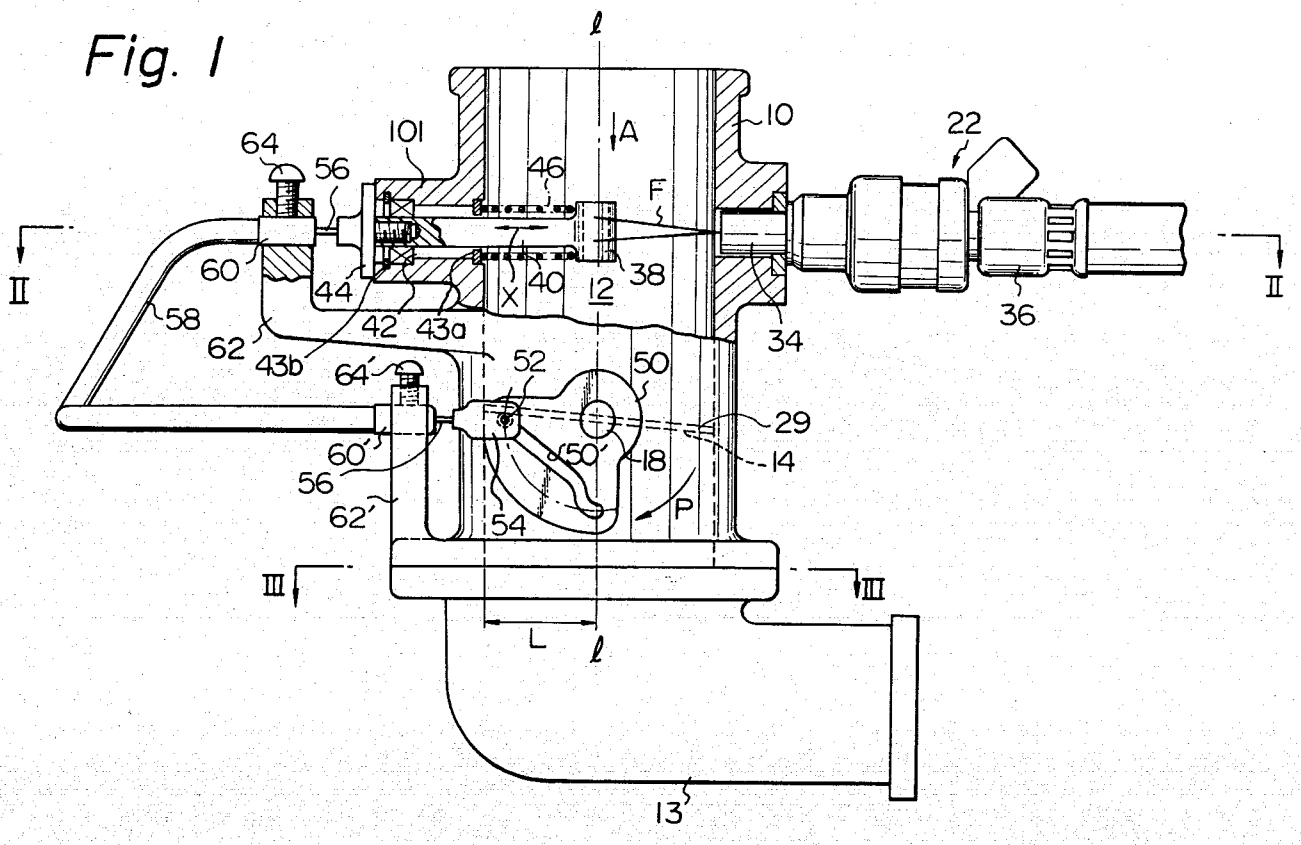
FIG. 1 is a vertical view of a fuel injection apparatus partially in cross-section, according to the present invention.
Figure 2:
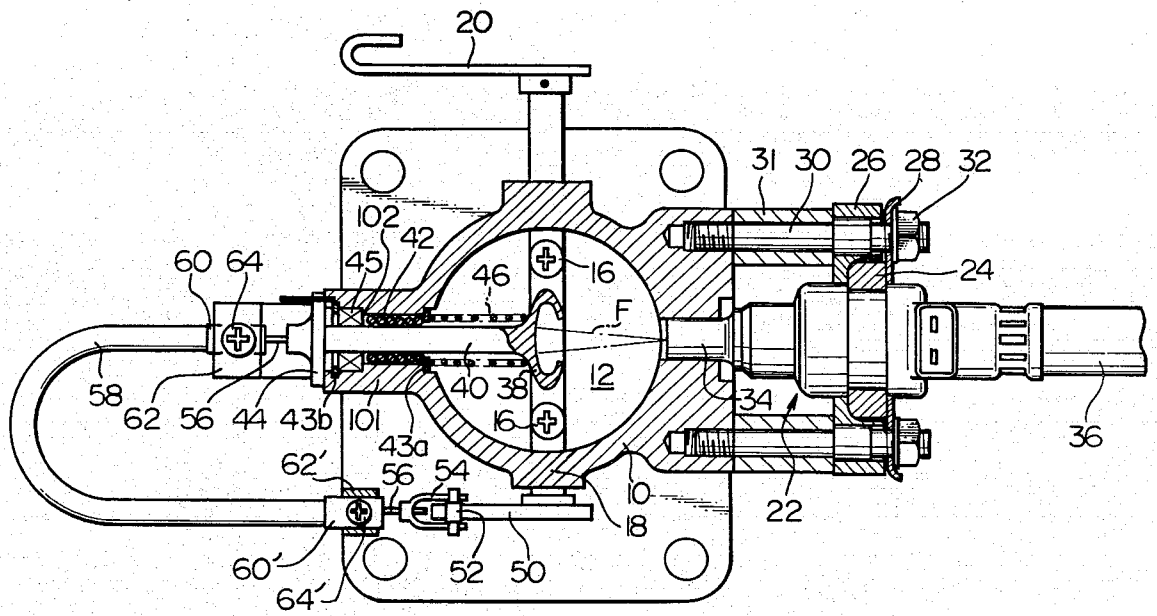
FIG. 2 is a cross-sectional view of the apparatus substantially along line II—II in FIG. 1.
Figure 3:
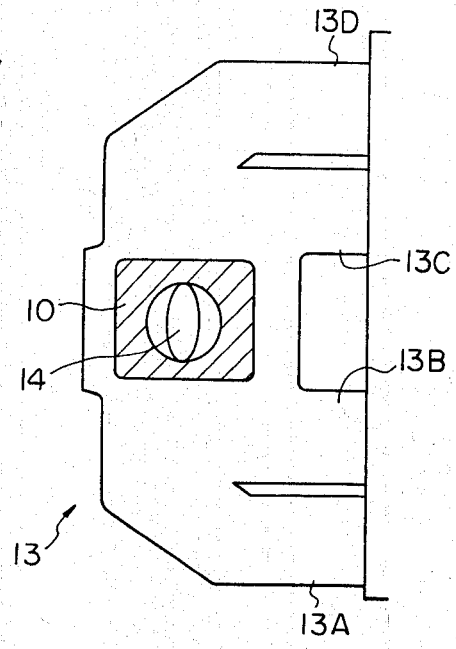
FIG. 3 is a top plan view of an intake manifold along a line III—III in FIG. 1.

Referring to FIGS. 1 and 2 showing an embodiment of the present invention, a reference numeral 10 designates a throttle body of tubular shape defining therein an axially elongated throttle bore 12. An upper end of the throttle body 10 is connected to an air cleaner (not shown) for receiving intake air therefrom, while a lower end of the throttle body is connected to an intake manifold 13 having a plurality of branch pipes 13A, 13B, 13C and 13D (FIG. 3) connected to respective combustion chambers or cylinders (not shown). A throttle valve of butterfly type 14 is arranged in the throttle body 10, which valve 14 is connected to, by screws 16, a throttle shaft 18 which is rotatably mounted to the throttle body 10. To an outer end of the throttle shaft 18 projected out of the throttle body 10, a throttle lever 20 is connected. The throttle lever 20 is connected to, via a link mechanism (not shown), to an accelerator pedal in order to open the throttle valve 14 as shown by an arrow P when the accelerator pedal is stepped on.

According to a multi-cylinder internal combustion of the present invention, a single fuel injection valve or nozzle 22 is provided for introducing fuel into all combustion chambers of the respective cylinders. The fuel injection nozzle 22 is connected to the throttle body 10 by means of an insulator 24 fitted to a body of the nozzle 22, a support member 26 located on one side of the insulator 24, a support plate 28 located on the opposite side of the insulator 24, bolts 30 screwed into the throttle body 10, spacers 31 and nuts 32 screwed into the respective bolts 30. The fuel injection valve 22, at one end thereof, is provided with a nozzle portion 34 opened to the throttle bore 12 from the lateral inner surface thereof. The fuel injection valve 22 is, at the other end thereof, provided with a fuel tube 36 which is adapted for receiving fuel from a fuel pump (not shown). The fuel injection valve 22 is operated by well known electro-magnetic means (not shown) in order to eject a single flow of fuel F which is directed along a direction substantially transverse to the direction of the flow of air, as shown by an arrow A.

According to the present invention a fuel collector or guide member 38 is located in the throttle bore 12 so that it faces a nozzle hole of the nozzle 34. The collector 38 is of a substantially C cross-sectional shape which is opened to the nozzle 34, allowing the flow of fuel discharged from the nozzle 34 to be caught by the collector 38. The collector 38 has on the side thereof remote from the open side, a rod portion 40. The rod portion 40 is passed through a horizontally elongated boss portion 101 of the throttle body 10. A linear bearing 42 for effecting a horizontal slide movement of the rod 40 in the boss portion 101 is arranged between a first ring member 43*a* and a seal member 45 which is fixedly connected to the boss portion 101 by means of a shoulder portion 102 and a second ring member 43*b*. A stopper 44 is screwed into an end of the rod portion 40 away from the collector member 38. A spring 46 is arranged between the back side of the collector 38 and the ring member 43 in order to urge the stopper 44 to contact with the outer end surface of the boss portion 101.

In order to vary the position of the collector 38 with respect to the axis of the flow of the fluid in the throttle bore 12, the following described cam mechanism is provided. A cam plate 50 is fixedly connected to an end of the throttle shaft 18 projected out of the throttle body 10 opposite to the throttle lever 20. The cam plate 50 is provided with a guide or cam slot 50′ to which a guide pin 52 as a cam follower roller is inserted. A joint member 54 of a substantially U shape is, on opposite ends thereof, fixedly connected to respective ends of the guide pin 52. The joint member 54 is connected to the stopper member 44 by way of a cable 56 made of a flexible material. The cable 56 is passed through a flexible tube 58. Opposite ends of the tube 58 are provided with collar portions 60 and 60′, respectively. The collar portions 60 and 60′ are inserted into stay members 62 and 62′, respectively, which are integral with the throttle body 10. Further, the portions 60 and 60′ are fixedly connected to the stay members 62 and 62′, by means of screws 64 and 64′, respectively.

An operation of the here-in above described apparatus will now be described.

Figure 4:
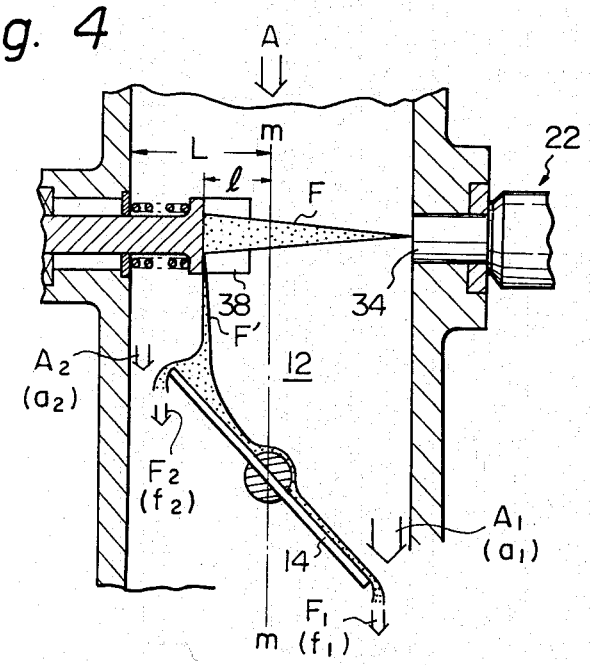
FIG. 4 is a partial view of FIG. 1, which illustrates an operation of the collector or guide member.

Air from the air cleaner (not shown) is introduced into the throttle bore 12 and is directed to the throttle valve 14, as shown by an arrow A in FIG. 4. Fuel from the fuel injector valve 22 is discharged into the throttle bore 12, as shown by an arrow F, and is caught by the collector member 38 and is directed to the throttle valve 14, as shown by an arrow F′.

When the throttle valve 14 is opened, air is passed through the throttle valve 14 at its right and left sides, as shown by arrows $A_1$ and $A_2$, respectively. Since the throttle valve 14 is inclined with respect to the axis m—m of the throttle bore 12, the amount of air $a_1$ passed through the right (or upper) side of the throttle valve 14, as shown by the arrow $A_1$, is larger than the amount of air $a_2$ passed through the left side of the throttle valve 14, as shown by the arrow $A_2$. Due to a flow dynamic effect a value of difference between the amount of air $a_1$ and $a_2$ changes in accordance with the degree $\theta$ of the opening of the throttle valve 14.

Figure 5:
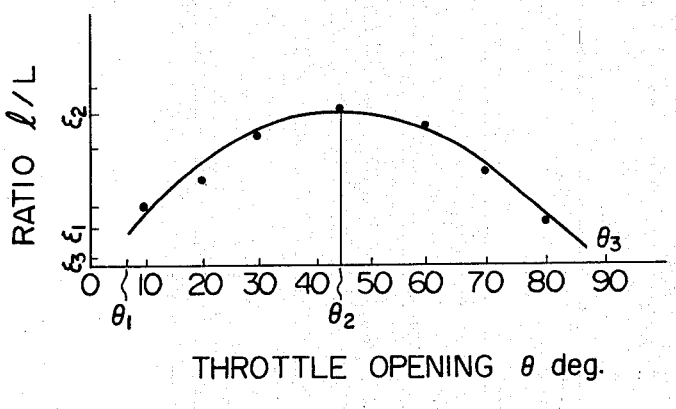
FIG. 5 is a graph indicating the relationship between the degree of the throttle opening and the degree of deviation of the axis of the flow of fuel directed to the throttle valve from the collector member.

The flow of fuel F′ directed from the collector member 38 is passed through the throttle valve 14 at its right and left sides, as shown by arrows $F_1$ and $F_2$, respectively. Since the collector member 38 is connected, via the cable 56, to the guide pin 52 engaging the cam groove 50′ of the cam plate 50 fixed to the throttle shaft 18, the collector member 38 moves transversely against the axis of the throttle bore 12, as shown by an arrow X (FIG. 1) in accordance with the degree of the throttle opening. As a result of the transverse motion of the collector member 38, the distance l of the corrector member 38 from the axis m—m of the throttle bore 12 is changed in accordance with the degree $\theta$ of the throttle opening. Therefore, the amount of fuel $f_1$ passed through the right side of the throttle valve, as shown by the arrow $F_1$, is larger than the amount of fuel $f_2$ passed through the left side of the throttle valve 14, as shown by the arrow $F_2$. The value of difference between the amount of fuel $f_1$ and $f_2$ changes in accordance with the degree $\theta$ of the throttle opening. It should be noted that a relationship between the distance l and the throttle opening $\theta$ is selected in such a manner that an air fuel ratio $a_1/f_1$ on the right side of the throttle valve is, at every degree of the throttle opening, equal to the air fuel ratio $a_2/f_2$ on the left side of the throttle valve. In a particular construction, as shown in the drawings, this relation is attained when a cam groove 50′ is so selected that a value ratio $\epsilon$ of the distance l to a radius L of the throttle bore 12 is changed in accordance with the degree $\theta$ of the throttle opening, as shown by FIG. 5. The value of $\epsilon$ when the throttle opening is as small as $\theta_1$ is $\epsilon_1$. When the throttle opening is in a middle position $\theta_2$, the value of $\epsilon$ is the maximum ($\epsilon_2$). When the throttle opening is as large as $\theta_3$, the value of $\epsilon$ is small ($\epsilon_3$).

As will be clear from the above, according to the present invention, there is a constant air-fuel ratio on both sides of the throttle valve, irrespective of degree of the throttle opening. As a result of this, according to the present invention, the air fuel mixture of a substantially constant air fuel ratio can be introduced into every branch pipe 13A, 13B, 13C and 13D connected to the respective cylinders of the engine. Therefore an idealized operation of the engine is obtained.

While the present invention is described with reference to a particular embodiment, many modifications and changes may be made by those skilled in this art.

We claim:

1. Fuel injection apparatus for a multi-cylinder internal combustion engine which includes a tubular body through which intake air passes and a butterfly throttle valve arranged in the body for controlling the amount of the flow of air passing therethrough, comprising:

fuel injection nozzle means secured to the body upstream of the throttle valve for providing a single flow of fuel into the interior of the body substantially transverse to the axis thereof and to the axis of rotational movement of the valve;

guide means in the body opposed to said nozzle means for intercepting the flow of fuel therefrom and directing said flow with a 90° change of direction toward the valve and parallel to the axis of the body, said guide means being mounted for linear movement transverse of the axis of the body toward and away from said nozzle means; and drive means connected to said guide member and to the valve and responsive to movements of the latter for moving said guide means so that the air-fuel ratio of the air-fuel mixture passing by the valve on one side of its said axis is substantially equal to the air-fuel ratio of the air-fuel mixture passing by the valve on the other side of its said axis irrespective of the degree of opening of the valve.

2. The structure defined in claim 1 wherein the surface of the guide means opposed to the nozzle means is substantially C-shaped in section transverse to the axis of the tubular body.

3. The structure defined in claim 1 wherein the drive means includes cam means rotatable with the valve for changing rotational movement thereof into linear movement and link means connecting said cam means with the guide member.

4. The structure defined in claim 3 wherein the cam means comprises a cam member connected to the valve and a cam follower connected to the link means.

5. The structure defined in claim 4 wherein the link means includes a Bowden wire.

* * * * *